US006105179A

United States Patent [19]

Burns

[11] Patent Number: 6,105,179

[45] Date of Patent: Aug. 22, 2000

[54] TOILET/BIDET SEAT

[76] Inventor: Robert Raymond Burns, Driehoek Straat 30, 1015 GL, Amsterdam, Netherlands

[21] Appl. No.: 09/255,312

[22] Filed: Feb. 22, 1999

[51] Int. Cl.[7] ..... A47K 3/20

[52] U.S. Cl. ..... 4/420.4

[58] Field of Search ..... 4/420.2, 420.4

[56] References Cited

U.S. PATENT DOCUMENTS

| | | | |
|---|---|---|---|
| 1,521,892 | 1/1925 | Koppin | 4/420.4 |
| 1,962,014 | 6/1934 | Guidetti | 4/420.4 |
| 3,995,326 | 12/1976 | Umann . | |
| 4,094,018 | 6/1978 | Bemthin . | |
| 4,197,594 | 4/1980 | Butterfield . | |
| 4,237,560 | 12/1980 | Riegelman et al. . | |
| 4,638,514 | 1/1987 | Landsberger . | |
| 4,642,820 | 2/1987 | Boring | 4/420.4 |
| 4,807,311 | 2/1989 | Ingels . | |
| 4,953,238 | 9/1990 | Shitterly | 4/420.2 |
| 5,189,740 | 3/1993 | Diethelm . | |
| 5,271,104 | 12/1993 | LaTora . | |
| 5,319,811 | 6/1994 | Hauri . | |
| 5,331,692 | 7/1994 | Alberti . | |
| 5,384,919 | 1/1995 | Smith . | |
| 5,504,948 | 4/1996 | Chandler . | |

FOREIGN PATENT DOCUMENTS

WO 85/0176 4/1985 WIPO .

*Primary Examiner*—Charles E. Phillips

*Attorney, Agent, or Firm*—Michael I. Kroll

[57] ABSTRACT

A toilet/bidet device connected to a seat of a toilet for cleaning a users genitals and posterior side. The toilet/bidet device including a water supply pipe connected to a main water line supplying water to the toilet, a valve positioned on an underside of the seat of the toilet and being connected to an end of the water supply pipe opposite the connection to the main water line and a water conduit wand positioned on the underside of the seat and having a first end connected to extend from the valve and a second end having a recess extending therethrough. The water conduit wand is pivotal within the valve. A handle is positioned on a side of the seat and connected to the water conduit wand for pivoting the water conduit wand between a first position and a second position. In the first position, the water conduit wand is not in alignment with the water pipe and in the second position the water conduit pipe is rotated to extend below a recess in the seat and in alignment with the water pipe thereby receiving water from the water pipe. The water received from the water pipe is caused to flow through the water conduit wand and out of the recess towards the genitals and posterior end of a user seated on a top side of the seat. A spring is connected between the water conduit wand and the underside of the seat for exerting a force on the water conduit wand in a direction opposite to the force applied by the handle for returning the water conduit wand to the first position upon release of a force from the handle. A guide track is also connected to the underside of the seat and includes a recess therein for receiving the water conduit wand therethrough and guiding movement of the water conduit wand between the first and second positions.

6 Claims, 10 Drawing Sheets

TOILET/BIDET SEAT

BACKGROUND OF THE INVENTION

1. Field of the Invention

The present invention relates generally to toilets and, more specifically, to a toilet seat having a bidet attached therein whereby the user can selectively wash the genitals and posterior parts of the body after use of the toilet.

2. Description of the Prior Art

Numerous types of toilet/bidet seats designed to deliver water for washing of the genitals and the posterior parts of a body have been provided in the prior art. For example, U.S. Pat. Nos. 3,995,326; 4,094,018; 4,197,594; 4,237,560; 4,638,514; 4,807,311; 5,189,740; 5,271,104; 5,319,811; 5,331,692; 5,384,919; 5,504,948; 5,505,302; 5,547,080; 5,603,405; 5,613,574 and PCT application No. WO85/0176 all are illustrative of such prior art. While these units may be suitable for the particular purpose to which they address, they would not be as suitable for the purposes of the present invention as heretofore described.

A toilet seat having an antisiphon bidet nozzle, an antisiphon vaginal wash nozzle, and the toilet seat forming housing for receiving a deodorant container, a warm air blower, a water heater, a manually accessible pressure regulator, a medication container, and an appropriate manually operated valve and switches for supplying water to the bidet and vaginal nozzles, and actuating the blower, the toilet seat having an adjustable mounting means for attachment to the toilet seat mounting means of a wide variety of toilet bowls.

A bottom douche for flush toilets comprises arms supported with one end on the toilet; spray nozzles carried at the free ends of said arms; duct means for passing water through said arms to said nozzles; a handle associated with the toilet, and a linkage connecting said handle and said arms for swiveling said arms and nozzles about a generally horizontal axis extending transversal to the seat of the toilet and for shifting the arms in a direction about parallel to said seat so as to bring the nozzles into spray position.

The apparatus is adapted to fit on the lower surface of conventional toilet seats, and comprises (1) a base element, (2) a support element, including handle, rotatably secured to the base element, (3) an elongated fluid carrying arm extending from the support, and (4) a spray head. By rotating the handle, the sprayhead moves through a relatively shallow arc from a retracted position adjacent the lower surface of the seat at the rear thereof through an operative path beneath the opening in the seat. The axis of rotation of the support element and the configuration of the fluid-carrying arm are such that the focal point of the arc of the sprayhead is several inches above the plane of the seat.

There is disclosed a bidet seat housing in which are front and rear water jet nozzles and director members through which to pass water one or the other of the nozzles via a solenoid-operated diverter valve connected to the outlet fitting on top of an elongated horizontal water tank adjacent one end thereof, such tank having its inlet fitting on top adjacent the other end connected to a water supply line via a solenoid operated pressure regulator. An external mode selector effects operation of one of either one of the solenoids or of a warm air blower for supplying warm air blower at the rear of the seat. The water tank contains a heater and a sensor with a temperature sensitive resistor. A control module has circuitry of which the sensor resistor is a part, and effects operation of the heater as needed to maintain water flowing through the tank at the desired temperature. Maintenance of such temperature is effected by construction of the inlet fitting so that it injects water into the top of the tank adjacent its inner surface and parallel to its axis towards the outlet end, and of the outlet fitting having an air escape opening adjacent the inner surface of the tank. A pressure switch operable from weight on the seat must be closed to permit any operations, and an over temperature thermal switch on the tank stops the system when water temperature exceeds a predetermined level.

A raised superimposed toilet seat and bidet-like device in combination is disclosed, wherein the raised seat is superimposed on the bowl of a conventional toilet and bidet-like device is arranged in a clearance channel on the underside of the seat, and is displaceable from a non-use to a use position for providing a cleansing action for sanitary or healing purposes, as the case may be.

A bidet attachment for conventional commodes which have a bowl. The attachment has a swing arm with a spray head that can be moved toward and away from the center of the bowl. The arm is mounted by a swivel mount. The swivel mount includes anti-siphon means, and a safety valve. The safety valve closes the system unless the swing arm is in place, thus making safe the use of a swing arm which can readily be removed for cleaning or storage.

A toilet seat assembly is provided with a toilet seat (1) as well as a toilet lid (8), which can be separated for cleaning from each other and from a bidet (42) arranged in a hollow projection of the toilet seat (1) by simple manipulation and without tools. Flank parts (38, 39) which are pivotably mounted on the housing (17) of the bidet with support pins (12, 13) made in one piece on the inside on the housing, are made in one piece with the toilet seat assembly (1). Actuating members, which cooperate with an elastic tongue (25) or with a disk (21) of the bidet (42) to actuate a pressure switch (27) or a valve (28), are also arranged in these flank parts. The housing (17) of the bidet (42) is closed practically completely and is protected from splashing water even when the toilet seat has been removed.

A toilet bidet provides a cold water supply hose for attachment to an existing toilet's filler tube, may include a heating unit mounted to the side of the existing toilet tank, a water delivery hose leading to a bracket housing mounted on the rim of the existing toilet bowl, and a pivotal bidet arm directing the water upwards through a bidet nozzle towards the center of the toilet bowl. The heating unit is activated by a tank mounted switch having a float switch or switch arm extending beneath the existing toilet's float arm, so that each time the toilet is flushed, and the float arm falls with the dropping water level in the tank, the float switch or switch arm is depressed, thereby activating the heating unit.

A water closet includes a toilet bowl, a toilet seat liftably and lowerably mounted on the toilet bowl, and an apparatus supported adjacent the toilet seat for the personal hygiene of the occupant of the water closet. The apparatus comprises a tank for storing water therein; and an air pump connected with the tank for introducing compressed air into the tank to place a volume thereof under pneumatic pressure. The air pump includes an actuating member for operating the air pump. The apparatus further has a spraying device connected to the tank and supported in a zone of the toilet seat for discharging, from the tank, water driven by the pneumatic pressure to clean the posterior of the occupant. A valve is connected between the tank and the spraying device. The valve has a closed position in which water is prevented from being discharged by the spraying device and an open position in which water is discharged from the spraying device.

The apparatus comprises a manifold rotatably attached to the undersurface of a toilet seat extending from front to back and shaped so that when it is rotated against the undersurface it skirts the opening in the seat. A lever is provided at the front end of the manifold for use in moving it between its in use position with the plane of the manifold normal to the undersurface and its stowed position, essentially flat against the undersurface. The back end of the manifold is joined by a rotary joint to a supply tube, also mounted on the undersurface near the back of the seat and at a right angle to the manifold. A valve in this tube controls flow to the manifold. There are several orifices in the manifold, directing flow upward when the manifold is in use. There are movable sleeves on the manifold, one near each orifice, used to close off any orifice(s) when desired. In its stowed position the portion of the manifold in which the orifices are located lies in a channel attached to the undersurface. The flanges of the channel direct flow to clean the manifold and prevent spray from escaping through the space between the seat and bowl rim.

A conventional toilet includes a bowl having a bowl interior supported upon a base and having a rectangular flush tank supplied from a conventional water supply. The bowl portion supports a conventional toilet seat having a center hole and a hinged attachment to the seat support portion of the bowl. A toilet seat supported bidet includes an elongated nozzle pipe having an upwardly directed nozzle pivotally supported on the underside of the toilet seat such that the nozzle water flow extends upwardly through the hole in the toilet seat. A slide valve is coupled to the nozzle pipe and is operated by a pivotal handle. A supply of heated water is coupled to the slide valve from a source of water under pressure. A pair of friction clips secure the nozzle pipe to the undersurface of the toilet seat in a frictional pivotal attachment to facilitate the angular movement of the nozzle pipe to affect angular motion of the nozzle.

A bidet attachment is built into a toilet seat, which toilet seat includes a chamber opening to the sides of the seat. The bidet attachment includes a spray nozzle connected to a water supply via lines and valves. The nozzle rotates from a storage position within the chamber of the seat to a use position over the toilet bowl. The supply lines and valves are housed within the seat with the threaded water inlet connectors and flow control knobs extending exteriorly of the toilet seat.

An add-on bidet includes a molded plastic seat (12) which has a channel shaped cross section. A pivoting spray arm (108) is stowed between the toilet-bowl rim and the inside of the channel. The inner wall (16) of the seat acts as a splash guard. The spray-arm is mounted in bearings (214, 102) which are formed in the walls (16, 18) of the seat. The seat is able to pivot, for raising, on a pair of stubby pivot pins (36, 38) widely space apart. One (38) is hollow, to convey water to the seat. There are no exposed hose pipes or other obtrusive components. The water control knobs (70, 71, 76) are accessibly located. Water leaves the spray-head (116) as a coherent tube of water, which gives rise to a soft, gentle stream, whether the flow volume is large or small. This is achieved by deflecting jets of water from nozzles so that the jets coalesce back into a stream.

SUMMARY OF THE PRESENT INVENTION

The present invention relates generally to toilets and, more specifically, to a toilet seat having a bidet attached therein whereby the user can selectively wash the genitals and posterior parts of the body after use of the toilet.

A primary object of the present invention is to provide a toilet/bidet seat that will overcome the shortcomings of prior art devices.

Another object of the present invention is to provide a toilet/bidet seat which is able to wash at least one of the genitals and posterior portions of a user's body.

A further object of the present invention is to provide a toilet/bidet seat including a handle pivotally connected to the side of the toilet seat for moving the bidet between an operating position and a non operative position.

A yet further object of the present invention is to provide a toilet/bidet seat wherein the bidet includes a ball valve positioned therein which is aligned with a water conduit when the bidet is in the operational position.

A still further object of the present invention is to provide a toilet/bidet seat including a spring connected to the bidet for applying a pressure to the bidet causing the bidet to move into the operating position when the handle is activated.

A further object of the present invention is to provide a toilet/bidet seat wherein the bidet will discontinue the flow of water therethrough and return to its original non operative position when the handle is released.

Another object of the present invention is to provide a toilet/bidet seat that is simple and easy to use.

A still further object of the present invention is to provide a toilet/bidet seat that is economical in cost to manufacture.

Additional objects of the present invention will appear as the description proceeds.

A toilet/bidet device connected to a seat of a toilet for cleaning a users genitals and posterior side is disclosed by the present invention. The toilet/bidet device including a water supply pipe connected to a main water line supplying water to the toilet, a valve positioned on an underside of the seat of the toilet and being connected to an end of the water supply pipe opposite the connection to the main water line and a water conduit wand positioned on the underside of the seat and having a first end connected to extend from the valve and a second end having a recess extending therethrough. The water conduit wand is pivotal within the valve. A handle is positioned on a side of the seat and connected to the water conduit wand for pivoting the water conduit wand between a first position and a second position. In the first position, the water conduit wand is not in alignment with the water pipe and in the second position the water conduit pipe is rotated to extend below a recess in the seat and in alignment with the water pipe thereby receiving water from the water pipe. The water received from the water pipe is caused to flow through the water conduit wand and out of the recess towards the genitals and posterior end of a user seated on a top side of the seat. A spring is connected between the water conduit wand and the underside of the seat for exerting a force on the water conduit wand in a direction opposite to the force applied by the handle for returning the water conduit wand to the first position upon release of a force from the handle. A guide track is also connected to the underside of the seat and includes a recess therein for receiving the water conduit wand therethrough and guiding movement of the water conduit wand between the first and second positions.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DETAILED DESCRIPTION OF THE PREFERRED EMBODIMENT

Figure 1:
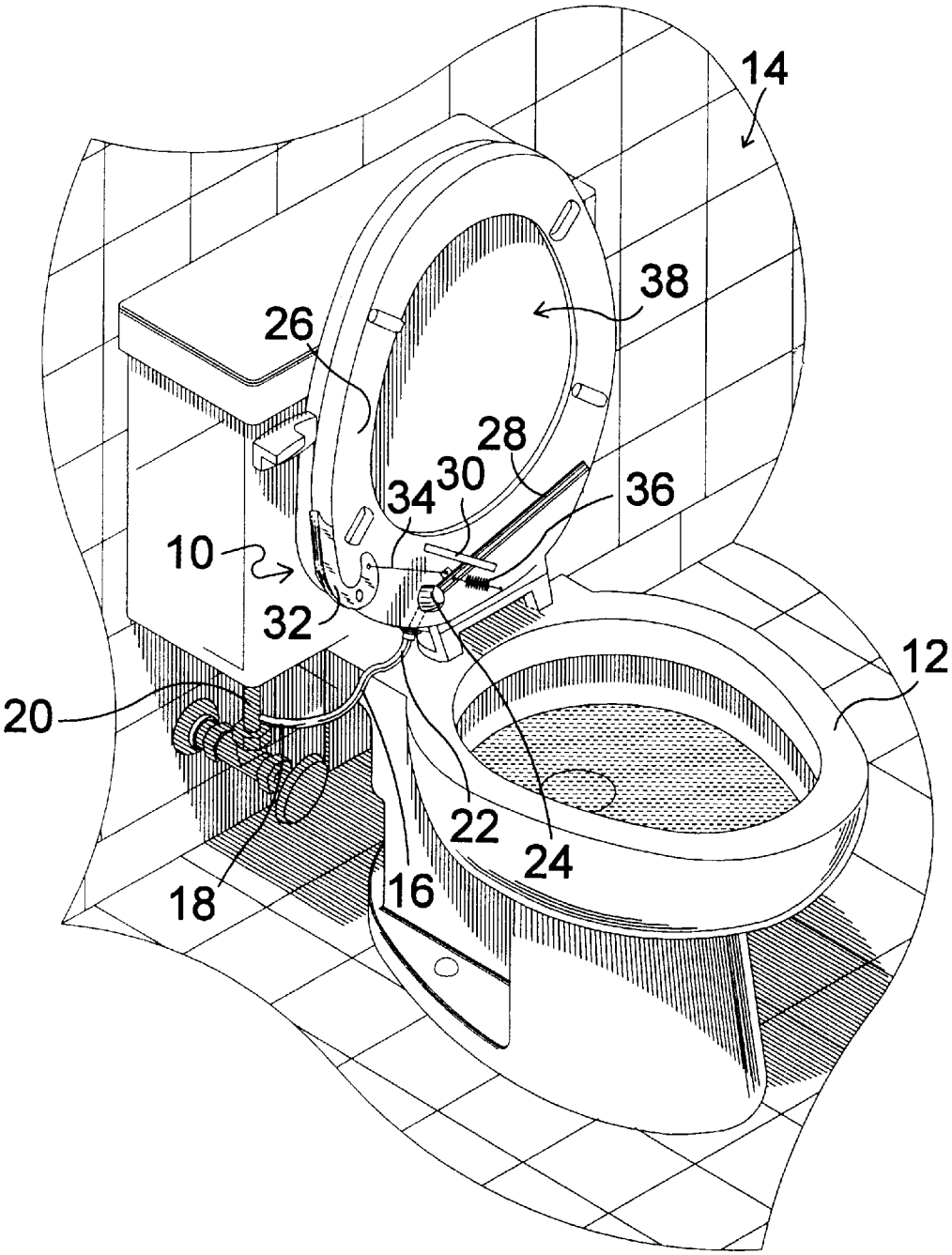
FIG. 1 is a top perspective view of a toilet to which the toilet/bidet seat of the present invention is connected.

Turning now descriptively to the drawings, in which similar reference characters denote similar elements throughout the several views, FIGS. 1 through 10 illustrate the toilet/bidet seat of the present invention indicated generally by the numeral 10.

The toilet/bidet seat 10 is illustrated in FIG. 1 attached to a toilet 12 positioned within a bathroom 14. The toilet/bidet seat 10 is shown in an upright position however, during use, the toilet/bidet seat 10 will be in down position whereby the user may sit on a top side thereof. The toilet/bidet seat 10 includes a water pipe 16 connected at a first end 18 to the main water line 20 and at a second end 22 to a ball valve 24. The ball valve 24 is connected to an underside 26 of the toilet/bidet seat 10. A water conduit wand 28 is connected to extend from the ball valve 24 and along the underside 26 of the toilet/bidet seat 10. A guide track 30 is also connected to the underside 26 of the toilet/bidet seat 10 for guiding the movement of the water conduit wand 28. A handle 32 is connected to a side of the toilet/bidet seat 10. The handle 32 is also connected to the water conduit wand 28 via a chain 34. A spring 36 is connected at a first end to the water conduit wand 28 on a side opposite the chain 34 and at a second end to the underside 26 of the toilet/bidet seat 10.

When the handle 32 is pulled by a user with enough force to overcome the tension of the spring 36, the water conduit wand 28 is caused to move along the guide track 30 and extend below a recess 38 in the toilet/bidet seat 10. In this position the water conduit wand 28 is aligned within the ball valve 24 to receive water flowing from the main water line 20 and through the water pipe 16. The water conduit wand 28 is hollow and includes a recess on an end opposite the connection to the ball valve 24. The recess can be seen in FIG. 7 and is identified by the numeral 40. When in this position water will flow through the water conduit wand 28, out through the recess 40 and towards the genitals and posterior side of the user. The water exiting the water conduit wand 28 will thus act to clean the genitals and posterior side of the user. When the handle 32 is released, the tension of the spring 36 causes the water conduit wand 28 to return to its original rest position. In this position the water conduit wand 28 is no longer aligned with the water pipe 16. Thus, the water conduit wand 28 will not receive any additional water.

Figure 2:
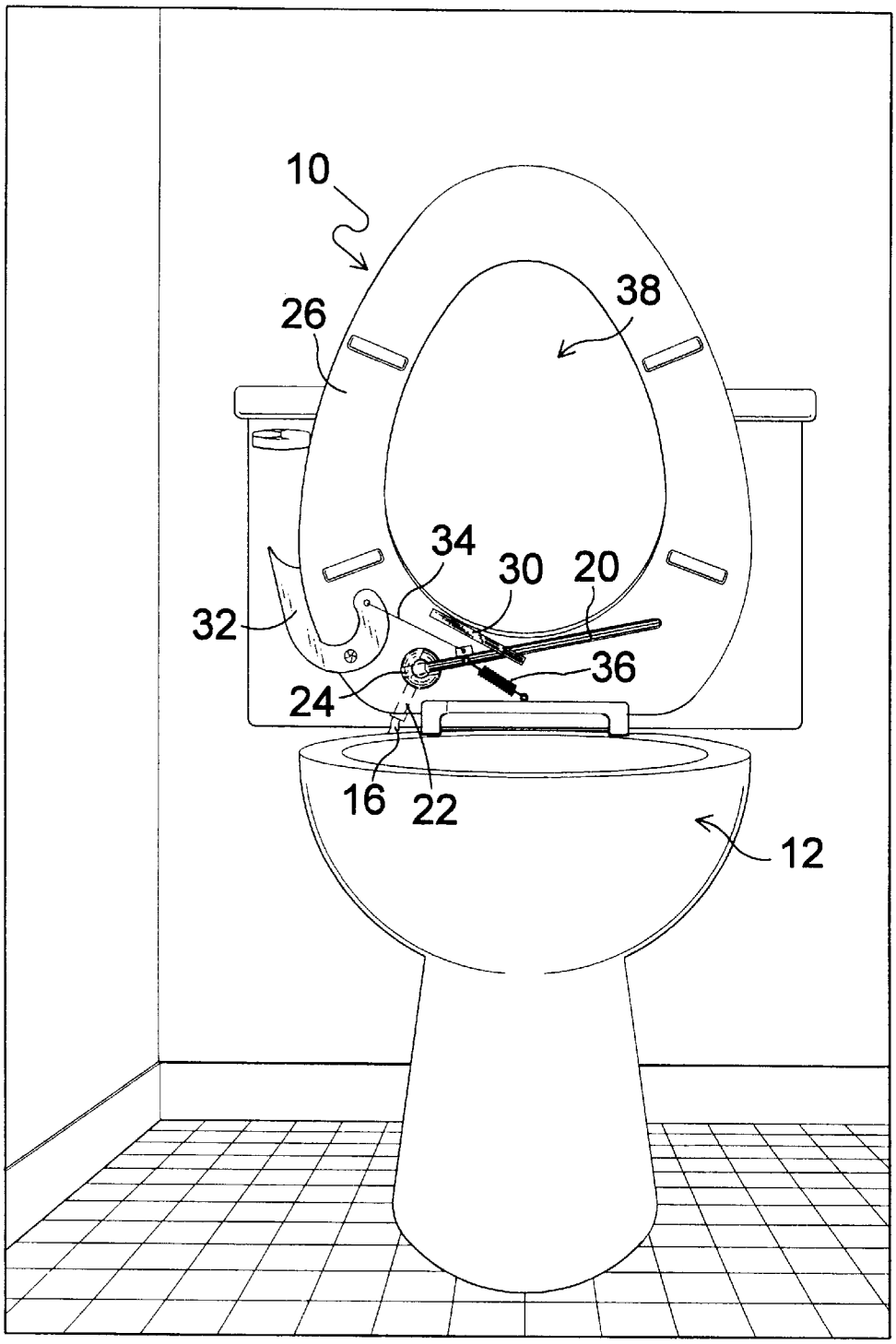
FIG. 2 is a front view of a toilet including the toilet/bidet seat of the present invention positioned thereon.
Figure 3:
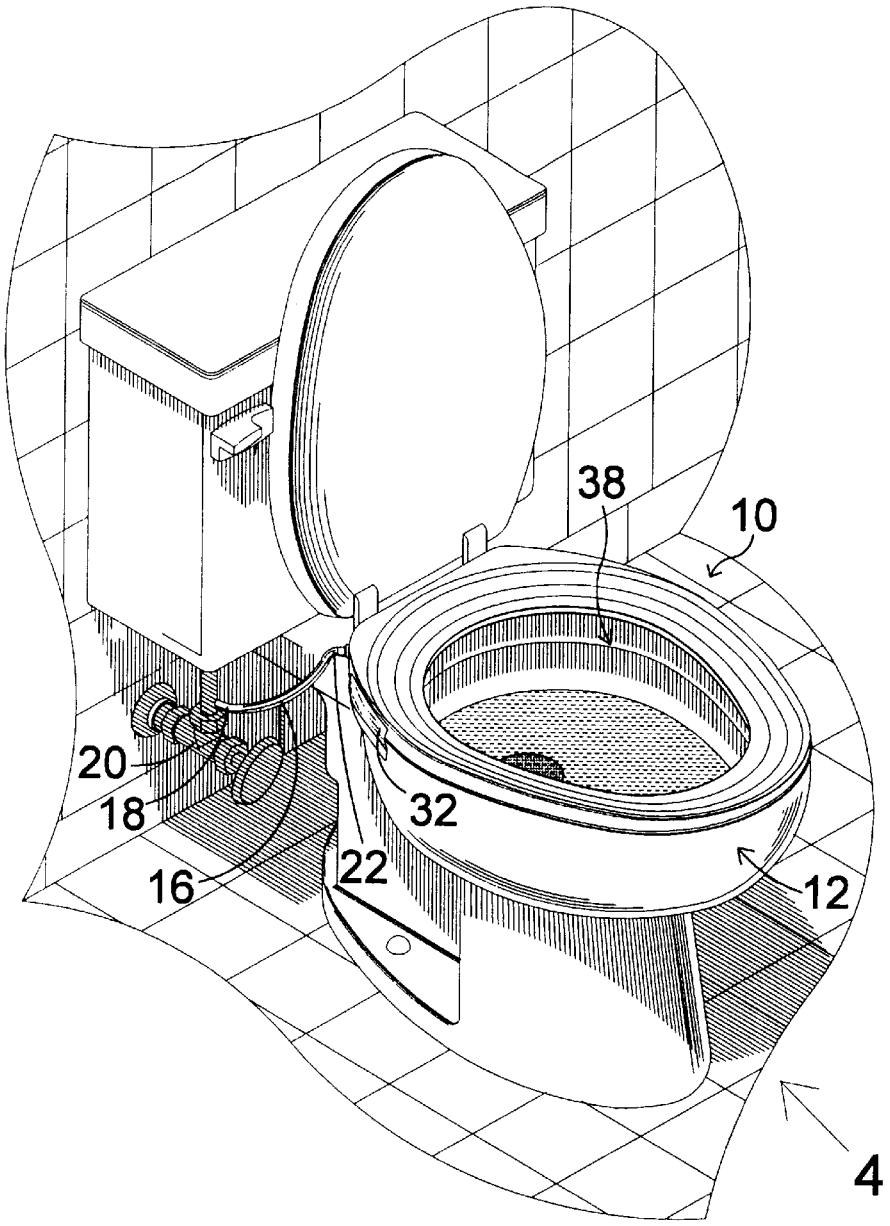
FIG. 3 is a top perspective view a toilet including the toilet/bidet seat of the present invention connected thereto, the seat being in the down position.

A front view of the toilet 12 including the toilet/bidet seat 10 connected thereto is illustrated in FIG. 2. In this view the toilet/bidet seat 10 is in an upright position similar to in FIG. 1. Clearly seen are the handle 32 connected to the water conduit wand 28 via the chain 34. The water conduit wand 28 is connected at a first end to extend from the ball valve 24 and is positioned between the guide track 30 and the underside 26 of the toilet/bidet seat 10. The spring 36 is also connected to exert a force on the water conduit wand 28 in a direction opposite to the force exerted by the handle 32. When the handle 32 is in the unextended position, the water conduit wand 28 is positioned completely below the underside of the toilet/bidet seat 10, not extending into or below the recess 38 in the toilet/bidet seat 10. The second end 22 of the water pipe 16 is connected to the ball valve 24 and supplies water from the main water line 20 to the water conduit wand 28 when a force is exerted on the water conduit wand 28 by the handle 32 causing the water conduit wand 28 to rotate within the ball valve 24 and thereby align with the water pipe 16. A top perspective view of the toilet/bidet seat 10 in a down position is illustrated in FIG. 3. In the down position, the toilet/bidet seat 10 is ready for use. As is shown in this figure, when the toilet/bidet seat 10 is in the non operative position, the water conduit wand 28 is positioned completely below the underside 26 of the toilet/bidet seat 10.

Figure 4:
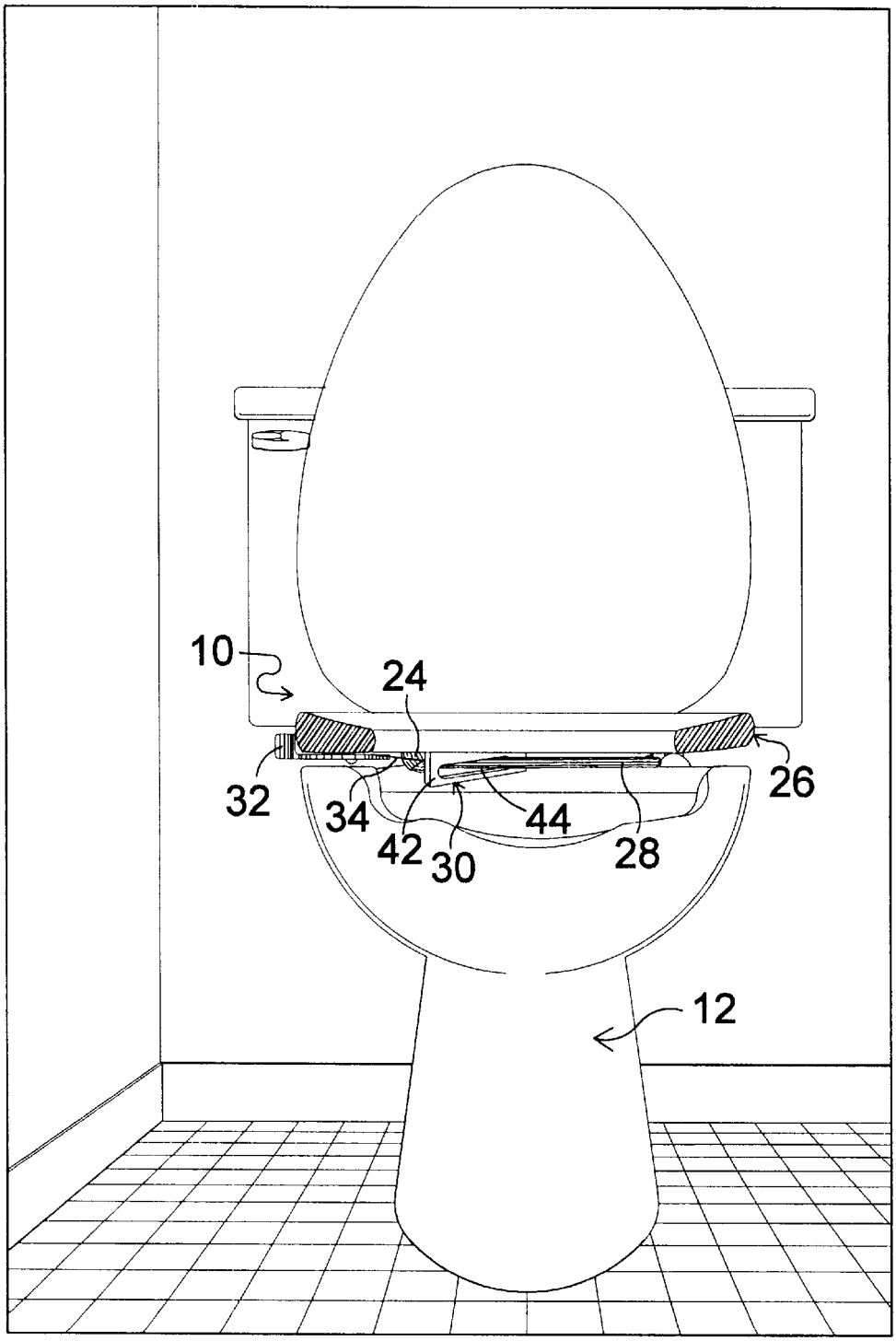
FIG. 4 is a front view in partial cross-section of a toilet to which the toilet/bidet seat of the present invention is connected as shown in the direction of the arrow labeled 4 in FIG. 3.

FIG. 4 illustrates the toilet/bidet seat 10 connected to the toilet 12 and in the down ready for use position as shown in FIG. 3. A portion of the toilet 12 and toilet/bidet seat 10 are cut away to illustrate the position of the handle 32 and water conduit wand 28 on the toilet/bidet seat 10 when in a down position. As can be seen from this figure, the guide rail 30 is a protruding block 42 extending from the underside 26 of the toilet/bidet seat 10 including a recess 44 extending therethrough along a length thereof. The water conduit wand 28 extends through the recess 44 and is movable within the recess 44.

Figure 5:
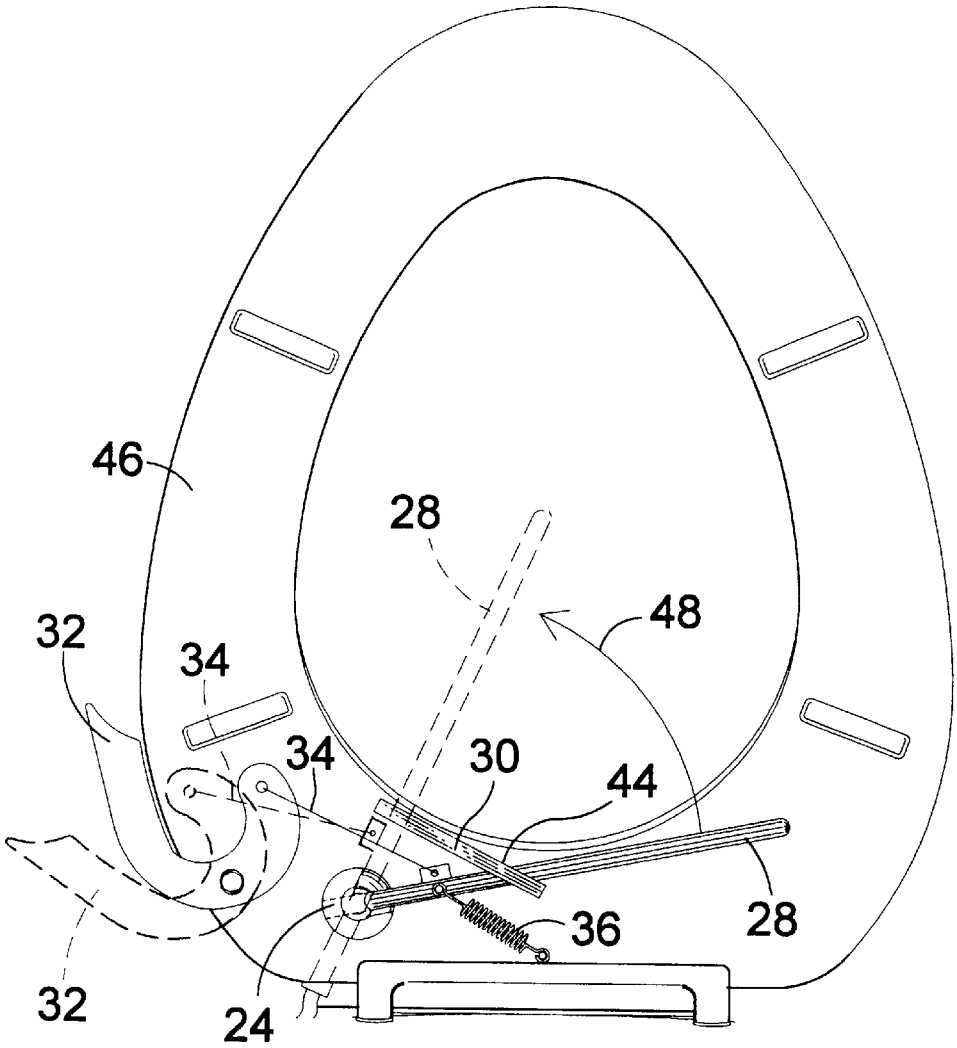
FIG. 5 is a bottom view of the toilet/bidet seat of the present invention in the non operative position, the bidet is illustrated in the operative position in dashed lines.

The underside 26 of the toilet/bidet seat 10 is illustrated in FIG. 5. The water conduit wand 28 and handle 32 are illustrated in their non operative position. The dashed lines illustrate the water conduit wand 28 and handle 32 in their operating position. In the non operative position, the handle 32 is positioned against a side of the seat portion 46 of the toilet/bidet seat 10. The water conduit wand 28 is positioned on one end of the recess 44 in the guide track 30 and is completely below the seat portion 46. The spring 36 and the chain 34 are in an intentioned state.

When a force is exerted on the handle 32, the handle 32 is caused to pivot to a position extending from the seat portion 46. As the handle 32 pivots, a force is exerted on the chain 34 causing the chain to exert a force on the water conduit wand 28 and spring 36. When the force is of a magnitude able to overcome the tension in the spring 36, the water conduit wand 28 is caused to pivot within the ball valve 24 in a direction indicated by the arrow labeled with the numeral 48. The water conduit wand 28 will pivot to extend below the recess 38 in the toilet/bidet seat 10 as indicated in dashed lines. The water conduit wand 28 is caused to move within the recess 44 to the opposite side of the recess 44 and the spring 36 is uncoiled and under tension. In this position the water conduit wand 28 is aligned with and receiving water from the water pipe 16. When the handle 32 is released, the force on the chain 34, water conduit wand 28 and spring 36 is removed. The spring 36 will recoil causing the water conduit wand 28 to return to its original at rest position.

Figure 6:
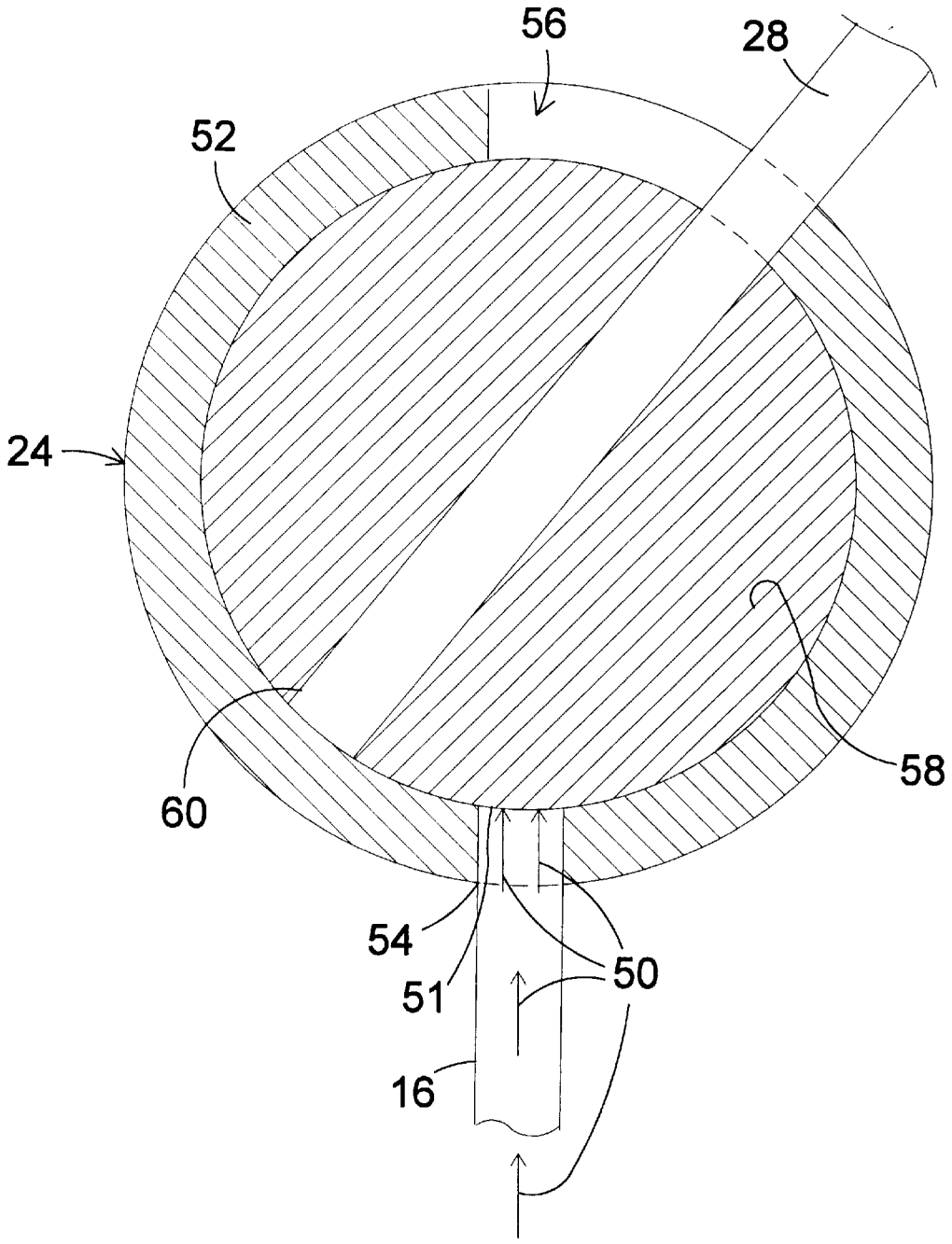
FIG. 6 is a cross-sectional view of the intake ball joint and water supply ball joint of the toilet/bidet seat of the present invention in the closed non operative position.
Figure 10:
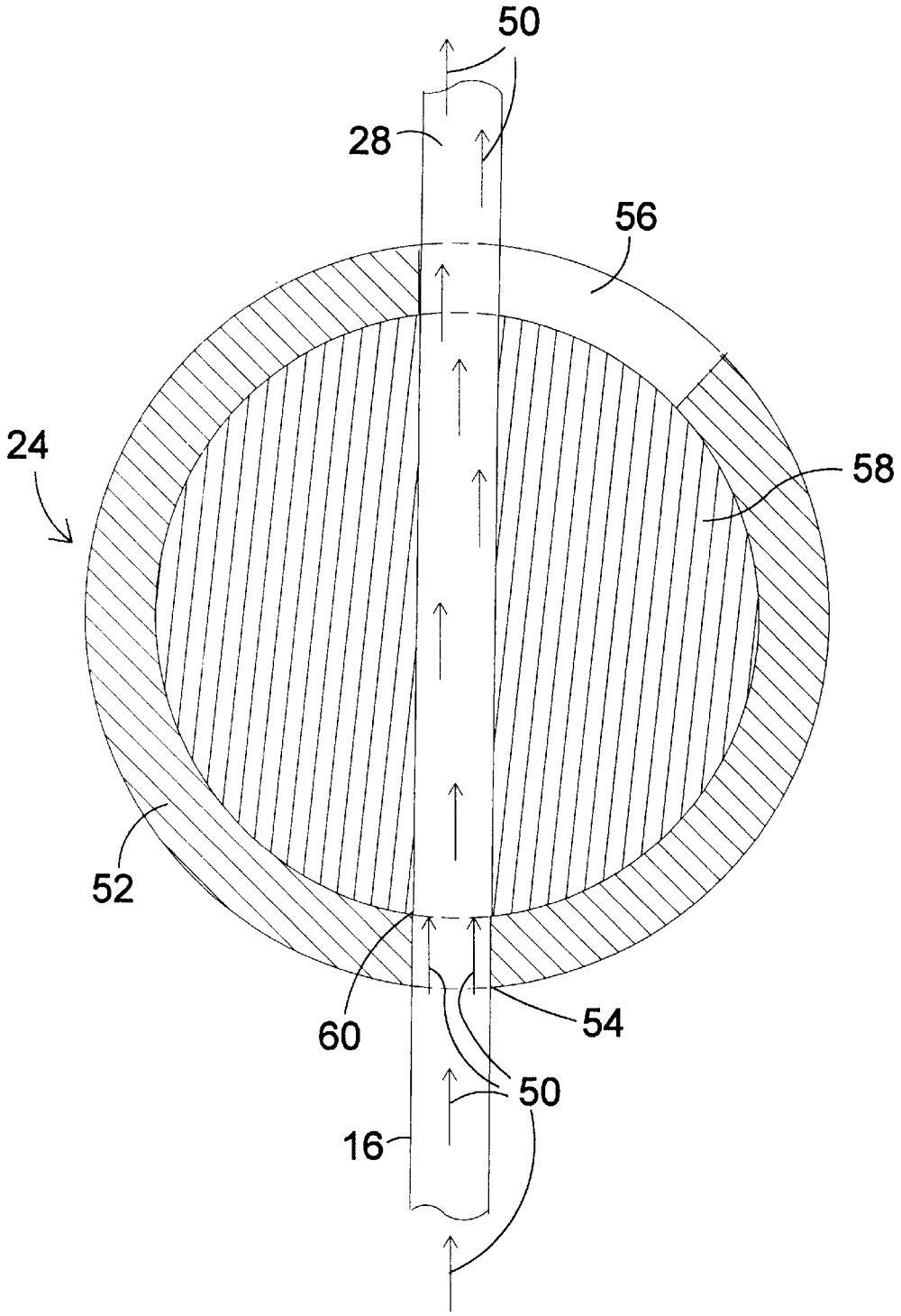
FIG. 10 is a cross-sectional view of the intake ball joint and water supply ball joint of the toilet/bidet seat of the present invention in the open operative position.

A cross-sectional view of the water pipe 16, ball valve 24 and water conduit wand 28 is illustrated in FIG. 6. From this figure and FIG. 10, the interaction of the water pipe 16 and water conduit wand 28 can be seen. FIG. 6 illustrates the water conduit wand 28 in its at rest position, non operative position. Water is flowing through the water pipe 16 at all times as indicated by the arrows labeled 50. The water will reach the ball valve 24 and hit a barrier wall 51 stopping its progress when the water conduit pipe 28 is in its at rest, non operative position. The ball valve 24 is formed of a circular shell 54 including a first recess 56 for receiving the water pipe 16 and a second recess 58 for receiving the water conduit wand 28. The water pipe 16 is snugly held within the first recess 54 while the water conduit wand 28 is movable within the second recess 56. Rotatably positioned within the shell 52 is a plug 58. The plug 58 includes a recess 60 extending through a diameter thereof which receives the water conduit wand 28. As a pressure is applied to the water conduit wand 28 by the chain 34 and handle 32, the water conduit wand 28 is caused to pivot with the plug 58 and thereby move along the length of the second recess 56 to a point at which the water conduit wand 28 is aligned with the water pipe 16. This allows water to flow therethrough as illustrated in FIG. 10. When the force is removed from the handle 32, the spring 36 causes the water conduit wand 28 to pivot back into its at rest position moving along the length of the second recess 56 while rotating the plug 58. In the at rest non operative position the first recess 54 is blocked by the plug 58.

Figure 7:
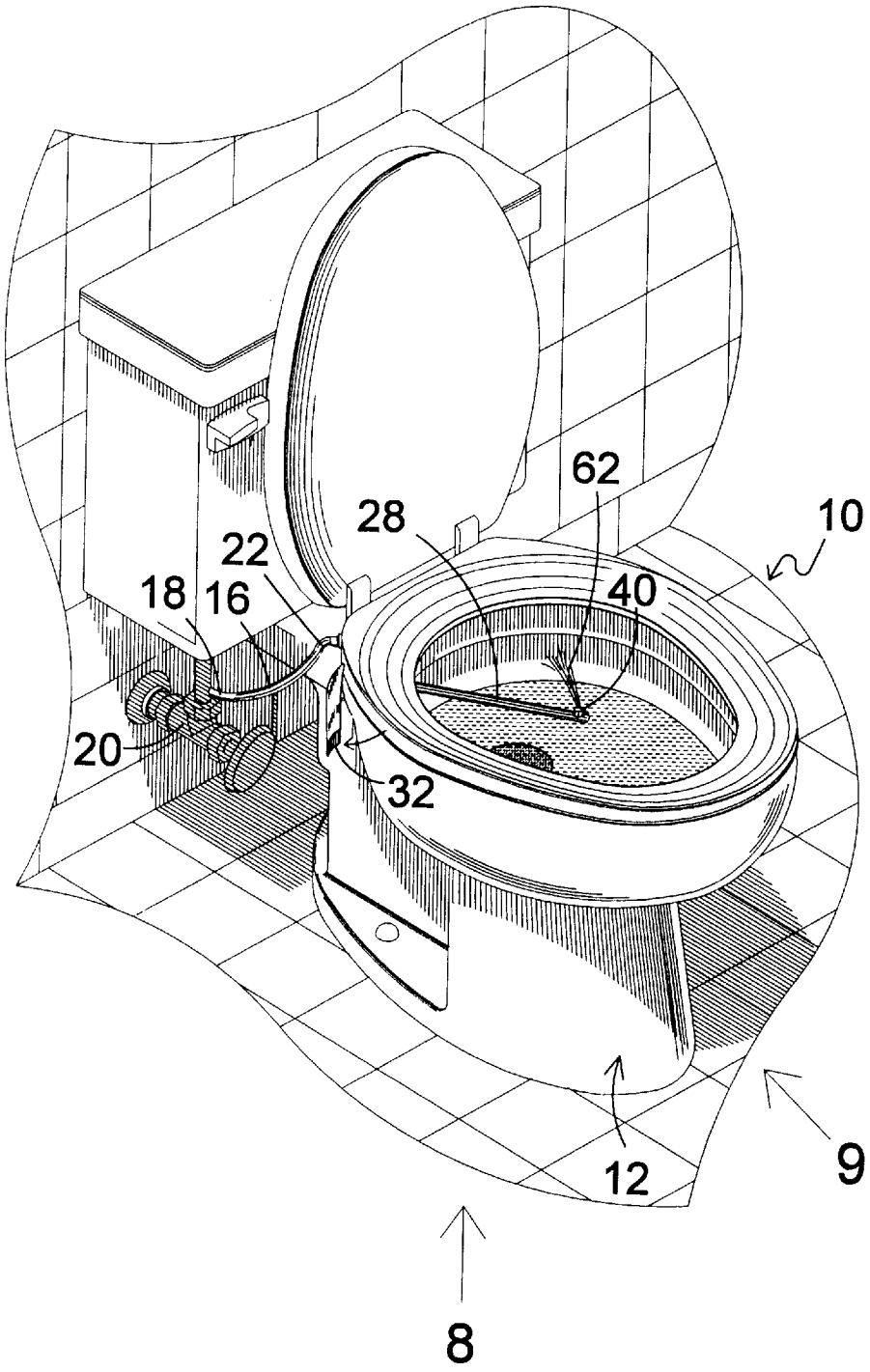
FIG. 7 is a top perspective view of the toilet/bidet seat of the present invention connected to a toilet and in an open operative position.
Figure 8:
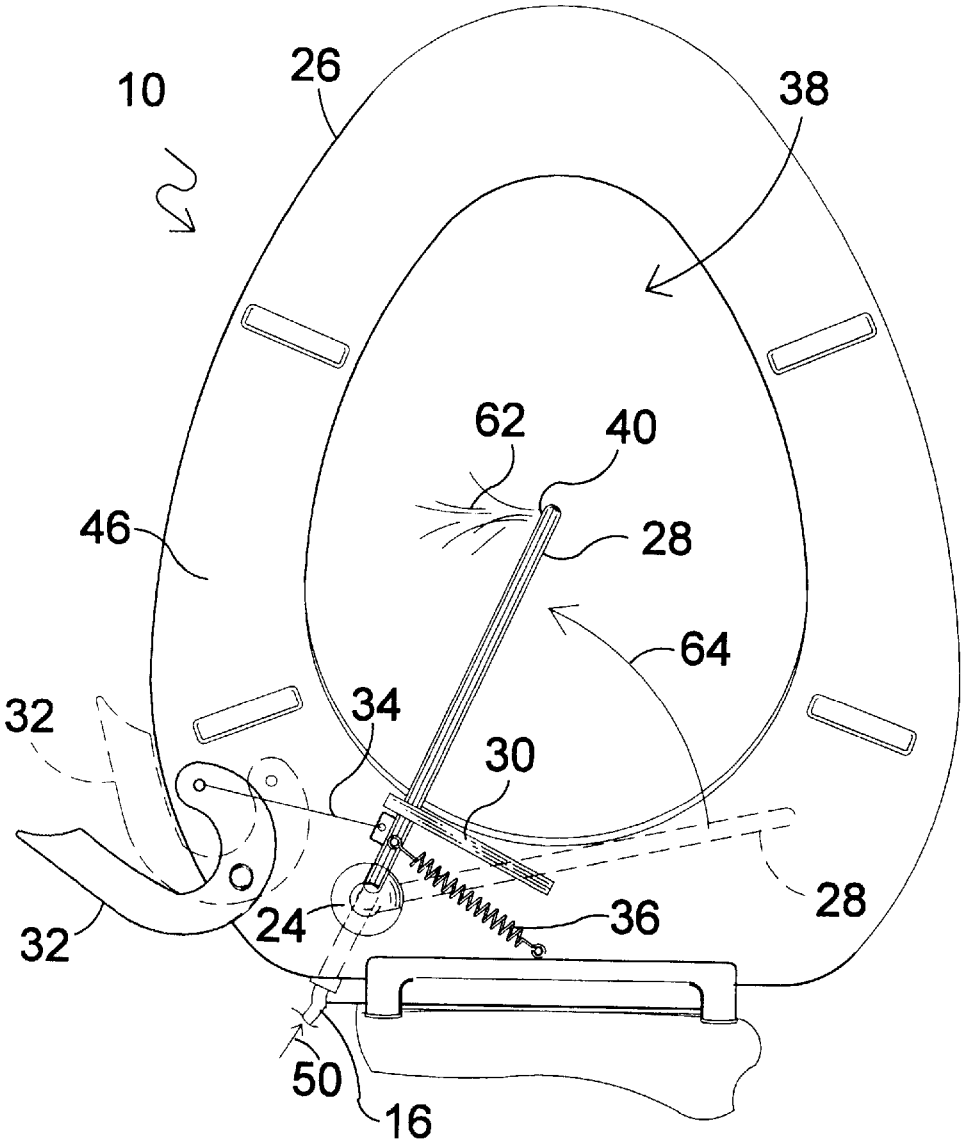
FIG. 8 is a bottom view of the toilet/bidet seat of the present invention in the open operative position.
Figure 9:
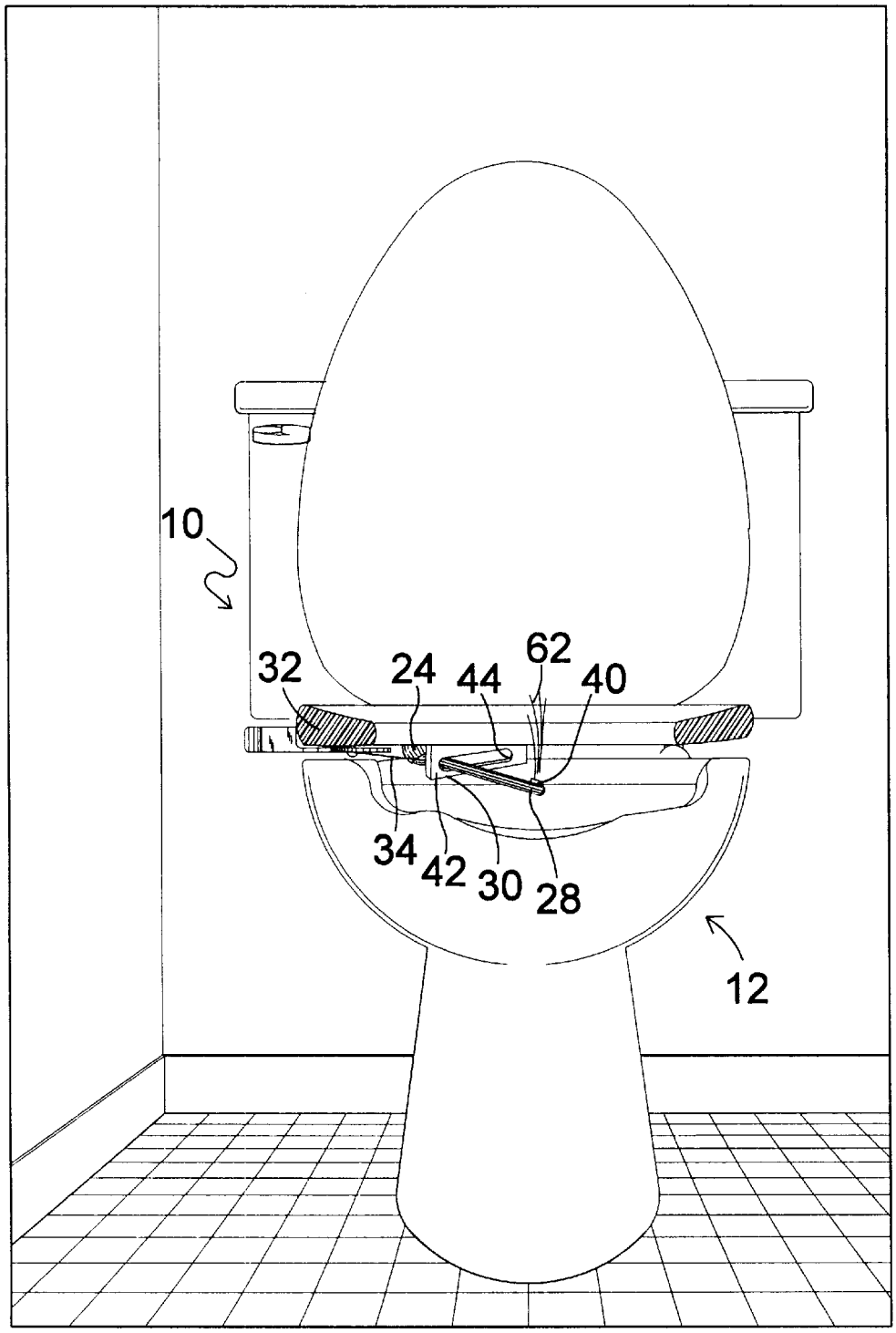
FIG. 9 is a front partial cross-sectional view of a toilet to which the toilet/bidet seat of the present invention is connected and in the open operative position.

FIGS. 7, 8 and 9 illustrate different views of the toilet/bidet seat 10 with the water conduit wand 28 in the operating position in which water is being provided through the recess 40. In this position, the water conduit wand 28 extends into a center of the toilet bowl 12 positioning the recess 40 below the recess 38 in the toilet/bidet seat 10. Water exiting the water conduit wand 28 through the recess 40 is thus able to pass through the recess 38 to contact and clean the genitals and posterior side of the user. The water exiting through the recess 40 is identified by the lines labeled 62. A top perspective view illustrating the water 62 exiting through the recess 40 is shown in FIG. 7 with a front view in partial cross section being illustrated in FIG. 9. FIG. 8 illustrates a bottom view if the toilet/bidet seat 10 with the water conduit wand 28 in the operating position, the dashed lines represent the handle 32 and water conduit wand 28 in the at rest, non operative position. In the operating position, the water conduit wand 28 is aligned in the ball valve 24 with the water pipe 16 to receive water therefrom. The water is shown exiting the water conduit wand 28 through the recess 40. In this position, the handle 32 is pivoted away from its position against the side of the seat portion 46 and the spring 36 is tensioned. The movement of the water conduit wand 28 from its at rest position to the operating position is indicated by the arrow labeled with the numeral 64. In the at rest non operating position indicated by the dashed lines, the handle 32 is positioned against the side of the seat portion 46 and the water conduit wand 28 is positioned completely below the underside 26 of the seat portion 46. In this position the water conduit wand 28 is not aligned with the water pipe 16 and thus does not receive water therefrom. The spring 36 is also recoiled and unstressed.

The operation of the toilet/bidet seat 10 will now be described with reference to the figures. In operation, the water pipe 16 of the toilet/bidet seat 10 is connected to the main water line 20 at a first end 18 and at a second end 22 is connected to the first recess 54 of the ball valve 24. The ball valve 24 is positioned on the underside 26 of the seat portion 46 and the water conduit wand 28 extends from the second recess 56 of the ball valve 24. The water conduit wand 28 extends through the plug 58 in the center of the shell 52 of the ball valve 28 and is pivotal therein. The guide track 30 is connected to the underside 26 of the seat portion 46 and the water conduit wand 28 extends through a recess 44 therein. The spring 36 is also connected to the underside 26 of the seat portion 46 at one end and to the water conduit wand 28 at its other end. The handle 32 is pivotally connected to a side of the seat portion 46 in a position easily reached by a user seated on the toilet 12. The handle 32 is connected to the water conduit wand 28 by the chain 34.

When a user has completed using the toilet 12, the handle 32 will be pulled. Exerting a force on the handle 32 in a direction away from the seat portion exerts a force on the chain 34 and thereby on the water conduit wand 28 and spring 36. The force applied to the water conduit wand 28 causes the water conduit wand 28 to pivot within the ball valve 24 and move along the length of the recess 44 in the guide track 30 and the recess 56 in the shell 52 of the ball valve 24. The water conduit wand 28 now extends below the recess 38 in the seat portion 46 and below the genitals and posterior side of the user. When the water conduit wand 28 reaches the end of the recess 44 and the recess 56, its motion is caused to stop and it is in alignment with the water pipe 16. Water flowing through the water pipe 16 is caused to flow into the water conduit wand 28 and out through the recess 40. This water is caused to contact and clean the genitals and posterior side of the user positioned thereabove.

When the user has finished cleaning the genital area and posterior side the handle 32 is released. The spring 36 it now allowed to recoil. As the spring 36 recoils it exerts a force on the water conduit wand 28 causing it to move back into its at rest non operative position below the underside 26 of the seat portion 46. This movement causes the water conduit wand to pivot within the ball valve 24 and become misaligned with the water pipe 16 preventing any additional water to be received therein. The toilet/bidet seat 10 is now back in its at rest position and ready for a subsequent user.

From the above description it can be seen that the toilet/bidet seat of the present invention is able to overcome the shortcomings of prior art devices by providing a toilet/bidet seat which is able to wash at least one of the genitals and posterior portions of a user's body. The toilet/bidet seat includes a handle pivotally connected to the side of the toilet seat for moving the bidet between an operational position and a non operative position and a ball valve for aligning a water pipe with a water conduit when the bidet is in the operational position. The toilet/bidet seat also includes a spring connected to the water conduit for applying a pressure thereto causing the water conduit to move back into an at rest position when a pressure is released from the handle. Furthermore, the toilet/bidet seat of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A toilet/bidet device connected to a seat of a toilet for cleaning a users genitals and posterior side, said toilet/bidet seat comprising:

a) a water supply pipe connected to a main water line supplying water to the toilet;

b) a valve positioned on an underside of the seat of the toilet, said valve being connected to an end of said water supply pipe opposite the connection to the main water line;

c) a water conduit wand positioned on the underside of the seat and having a first end connected to extend from said valve and a second end having a recess extending therethrough, said water conduit being pivotal within said valve;

d) means for pivoting said water conduit want between a first position in which said water conduit wand is not in alignment with said water pipe and a second position in which said water conduit pipe is rotated to extend below a recess in the seat and in alignment with said water pipe thereby receiving water from the water pipe, the water received from said water pipe being caused to flow through said water conduit pipe and out of said recess towards the genitals and posterior end of a user seated on a top side of the seat; and e) a guide track connected to the underside of the seat and including a recess therein for receiving the water conduit wand therethrough, said guide track guiding movement of said water conduit wand between said first and second positions.

2. A toilet/bidet device connected to a seat of a toilet for cleaning a users genitals and posterior side, said toilet/bidet seat comprising:

a) a water supply pipe connected to a main water line supplying water to the toilet;

b) a valve positioned on an underside of the seat of the toilet, said valve being connected to an end of said water supply pipe opposite the connection to the main water line;

c) a water conduit wand positioned on the underside of the seat and having a first end connected to extend from said valve and a second end having a recess extending therethrough, said water conduit being pivotal within said valve;

d) means for pivoting said water conduit want between a first position in which said water conduit wand is not in alignment with said water pipe and a second position in which said water conduit pipe is rotated to extend below a recess in the seat and in alignment with said water pipe thereby receiving water from the water pipe, the water received from said water pipe being caused to flow through said water conduit pipe and out of said recess towards the genitals and posterior end of a user seated on a top side of the seat; and e) said valve including a shell having a first recess therein for receiving said water pipe and a second recess for receiving said water conduit wand, said second recess having a length greater than the diameter of said water conduit thereby allowing said water conduit wand to be movable along the length of said second recess.

3. The toilet/bidet seat as recited in claim 2, further comprising a plug rotatably positioned within said shell, said water conduit wand extending through said plug whereby said plug rotates said water conduit wand to align with said water pipe when in said second position.

4. A toilet/bidet seat connected to toilet for cleaning a users genitals and posterior side, said toilet/bidet seat comprising:

a) a toilet seat having a top side, an underside and a recess extending through a central portion thereof;

b) a water supply pipe connected to a main water line supplying water to the toilet;

c) a valve positioned on said underside of said seat, said valve being connected to an end of said water supply pipe opposite the connection to the main water line;

d) a water conduit wand positioned on said underside of said seat and having a first end connected to extend from said valve and a second end having a recess extending therethrough, said water conduit wand being pivotal within said valve;

e) means for pivoting said water conduit wand between a first position in which said water conduit wand extends below said underside of said seat and is not in alignment with said water pipe and a second position in which said water conduit pipe is rotated to extend below said recess in the seat and in alignment with said water pipe thereby receiving water from the water pipe, the water received from said water pipe being caused to flow through said water conduit pipe and out of said recess in said water conduit pipe towards the genitals and posterior end of a user seated on a top side of the seat; and f) a guide track connected to said underside of said seat and including a recess therein for receiving said water conduit wand therethrough, said guide track guiding movement of said water conduit wand between said first and second positions.

5. A toilet/bidet seat connected to toilet for cleaning a users genitals and posterior side, said toilet/bidet seat comprising:

a) a toilet seat having a top side, an underside and a recess extending through a central portion thereof;

b) a water supply pipe connected to a main water line supplying water to the toilet;

c) a valve positioned on said underside of said seat, said valve being connected to an end of said water supply pipe opposite the connection to the main water line;

d) a water conduit wand positioned on said underside of said seat and having a first end connected to extend from said valve and a second end having a recess extending therethrough, said water conduit wand being pivotal within said valve;

e) means for pivoting said water conduit wand between a first position in which said water conduit wand extends below said underside of said seat and is not in alignment with said water pipe and a second position in which said water conduit pipe is rotated to extend below said recess in the seat and in alignment with said water pipe thereby receiving water from the water pipe, the water received from said water pipe being caused to flow through said water conduit pipe and out of said recess in said water conduit pipe towards the genitals and posterior end of a user seated on a top side of the seat;

f) said valve including a shell having a first recess therein for receiving said water pipe and a second recess for receiving said water conduit wand, said second recess having a length greater than diameter of said water conduit wand thereby allowing said water conduit wand to be movable along the length of said second recess.

6. The toilet/bidet seat as recited in claim 5, further comprising a plug rotatably positioned within said shell, said water conduit wand extending through said plug whereby said plug rotates said water conduit wand to align with said water pipe when in said second position.

* * * * *